US005551566A

United States Patent [19]

Sutherland

[11] Patent Number: 5,551,566

[45] Date of Patent: Sep. 3, 1996

[54] CAN CLIP CARRIER

[75] Inventor: Robert L. Sutherland, Kennesaw, Ga.

[73] Assignee: Riverwood International Corporation, Atlanta, Ga.

[21] Appl. No.: 416,385

[22] Filed: Apr. 6, 1995

[51] Int. Cl.[6] ..... B65D 71/12

[52] U.S. Cl. ..... 206/427; 206/150; 206/151

[58] Field of Search ..... 206/141, 145, 206/147, 149, 150, 151, 158, 161, 427

[56] References Cited

U.S. PATENT DOCUMENTS

| | | | |
|---|---|---|---|
| 2,950,041 | 8/1960 | Stone | 206/158 |
| 4,453,630 | 6/1984 | Helms et al. | 206/147 |
| 4,487,312 | 12/1984 | Heider | 206/158 |
| 5,323,895 | 6/1994 | Sutherland et al. | 206/161 |
| 5,328,024 | 7/1994 | Sutherland | 206/161 |

FOREIGN PATENT DOCUMENTS

| | | | |
|---|---|---|---|
| 2271097 | 4/1994 | United Kingdom | 206/151 |

*Primary Examiner*—Jimmy G. Foster

[57] ABSTRACT

A can clip carrier having support tabs on both top and bottom panels. The panels are in face-to-face contact, with the bottom panel tabs located between and in contact with the upper portion of the cans and the top panel support tabs. The bottom tabs are spaced apart a distance such that some of the top panel tabs engage the upper portion of the cans between spaced bottom panel tabs.

12 Claims, 2 Drawing Sheets

CAN CLIP CARRIER

FIELD OF THE INVENTION

This invention relates to article carriers. More particularly, it relates to a can carrier of the type that grips the upper portion of a plurality of cans so as to suspend them from the carrier.

BACKGROUND OF THE INVENTION

It is known to employ paperboard carriers which grip the top portions of cans so that the cans are suspended from a support panel. One such carrier design consists of a top panel spaced from a bottom support panel by short side panels, with the tops of the cans located in the space between the top and bottom panels. The cans are introduced to the carrier through apertures in the bottom panel and typically are held in place by support tabs which extend up from the bottom panel to engage the underside of the can chimes. Finger openings in the top panel enable the carrier to be lifted and carried.

A problem with such clip-type carriers is that despite the presence of a top panel and side panels, it is primarily the support tabs of the bottom panel which support the cans, which requires the paperboard used to form the carrier to be of substantial thickness or caliper. In addition, although the support tabs at least partially engage the upper side portions of the cans, they do not normally tightly grip the sides of the cans, leaving it primarily to the ends of the support tabs to actually support the weight of the cans.

It would be desirable to strengthen clip-type carriers to make the carriers better able to support heavy beverage cans. In the past this has been difficult to do without substantially increasing the cost of the carrier as a result of making the carrier from paperboard of greater caliper or adding an additional ply to the bottom panel. It is therefore an object of the invention to provide a can clip carrier with increased ability to support heavy loads without increasing the cost of the carrier.

SUMMARY OF THE INVENTION

A plurality of articles, each of which has an outwardly projecting lip, are contained in a carrier comprised of a top panel and an adjacent substantially parallel bottom panel. Each panel contains a plurality of aligned apertures through which the upper portion of an associated article extends. A plurality of support tabs are connected to both the top and bottom panels along fold lines adjacent the apertures. These support tabs engage the lip of an associated article, with at least some of the bottom panel support tabs being located between, and in contact with, the upper portion of an associated article and an adjacent top panel support tab. This arrangement results in the support tabs tightly gripping the sides of the articles in addition to supporting the articles by their lip.

Preferably, the bottom panel support tabs are spaced from each other so that an adjacent upper panel support tab is in contact with both a bottom panel support tab and the upper portion of an associated article.

The carrier preferably is formed from a single blank, but may also be formed from separate top and bottom panel blanks. Although the carrier is economical to produce, it is extremely sturdy and capable of supporting a number of articles without danger of failing.

The features of the invention which enable it to provide the desired results are brought out in more detail in the description of the preferred embodiment, wherein the above and other aspects of the invention, as well as other benefits, will readily become apparent.

DETAILED DESCRIPTION OF THE PREFERRED EMBODIMENT

Figure 1:
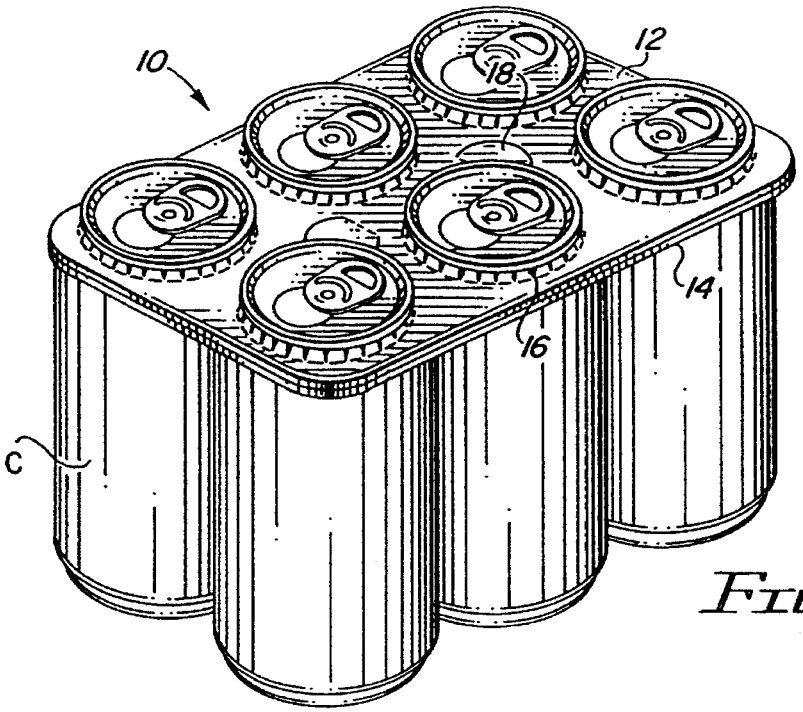
FIG. 1 is a pictorial view of a package of beverage cans incorporating the novel carrier of the present invention.

Referring to FIG. 1, a carrier 10 is comprised of top and bottom support panels 12 and 14, respectively, arranged in face-to-face relationship to form a substantially planar carrier unit. The upper portions of cans C extend through openings in the carrier and are supported by a number of support tabs. Although the support tabs are connected to both the top and bottom panels, only the support tabs 16 of the top panel are visible in this view. Finger hole tabs 18, which are foldably connected to the top panel, cover finger holes in the top panel. Aligned finger holes are also provided in the bottom panel but cannot be seen in this view.

Figure 2:
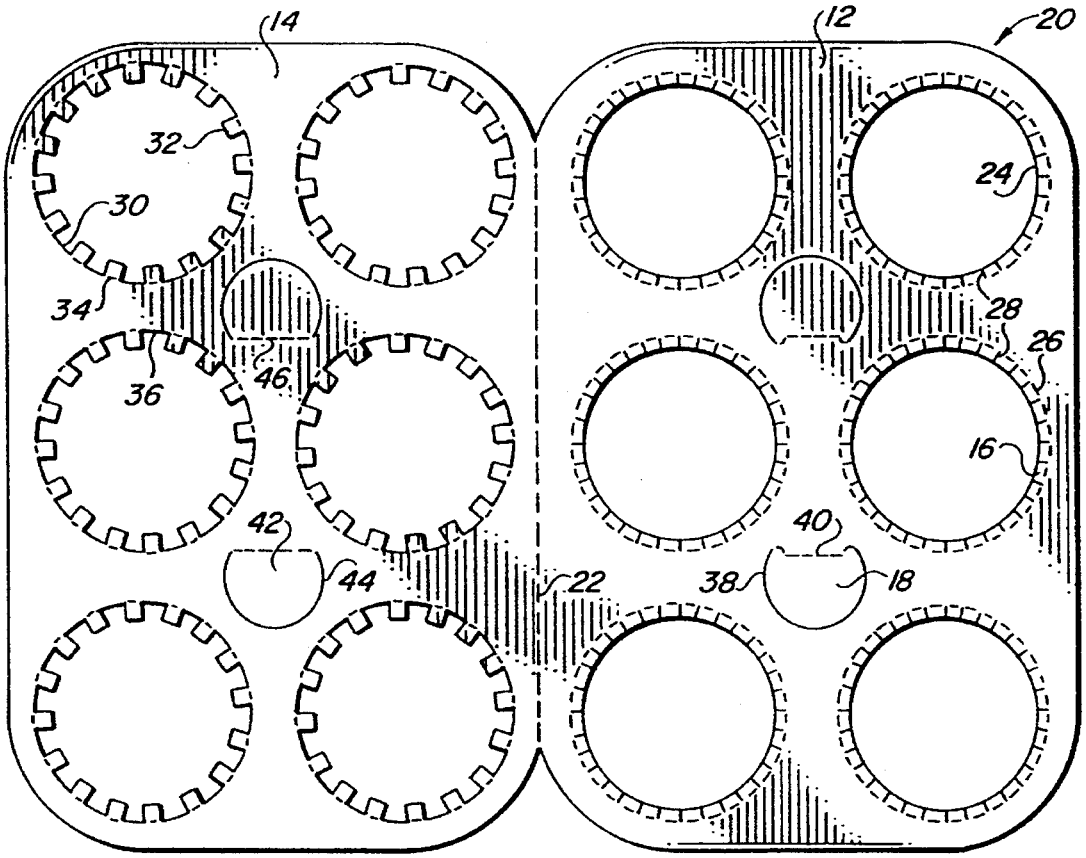
FIG. 2 is a plan view of a blank for forming the carrier of FIG. 1.

Referring to FIG. 2, wherein like reference numerals to those used in FIG. 1 denote like structure, the carrier is formed from a substantially rectangular blank 20 of flexible sheet material, such as paperboard. The blank is divided into top and bottom panel sections 12 and 14, respectively, connected by fold line 22. The top panel section 12 is provided with two rows of three identical circular apertures 24 to form a grouping of six apertures. Each aperture is ringed by a series of support tabs 16 connected to the top panel section along fold lines 26, which together form the circular outline of the apertures in the top panel of a carrier formed from the blank. Each support tab is substantially contiguous to adjacent tabs, being separated only by slits 28.

The bottom panel section 14 is also provided with two rows of three identical circular apertures 30 to form a grouping of six apertures. Each aperture is ringed by a series of spaced support tabs 32 connected to the bottom panel section along fold lines 34, which together with the arcuate edges 36 of the bottom panel section extending between the bases of the tabs 32 form the circular outline of the apertures in the bottom panel of a carrier formed from the blank. Although the width of the tabs 32 and the spaces between them may vary, as discussed in more detail below, in the preferred embodiment the width of the tabs 32 is equal to the width of the spaces between them to form a tab arrangement which is gear-like in appearance. The width of the tabs 16 in the top panel section is preferably equal to the width of the tabs 32. In any case, the length of the tabs 16 is less than the length of the tabs 32 as explained further below.

The finger hole tabs 18 in the top panel section 12 are formed by slits 38 and are connected to the top panel section by fold lines 40. In a similar arrangement finger hole tabs 42 are formed in the bottom panel section 14 by slits 44 and are connected to the bottom panel section by fold lines 46.

Figure 3:
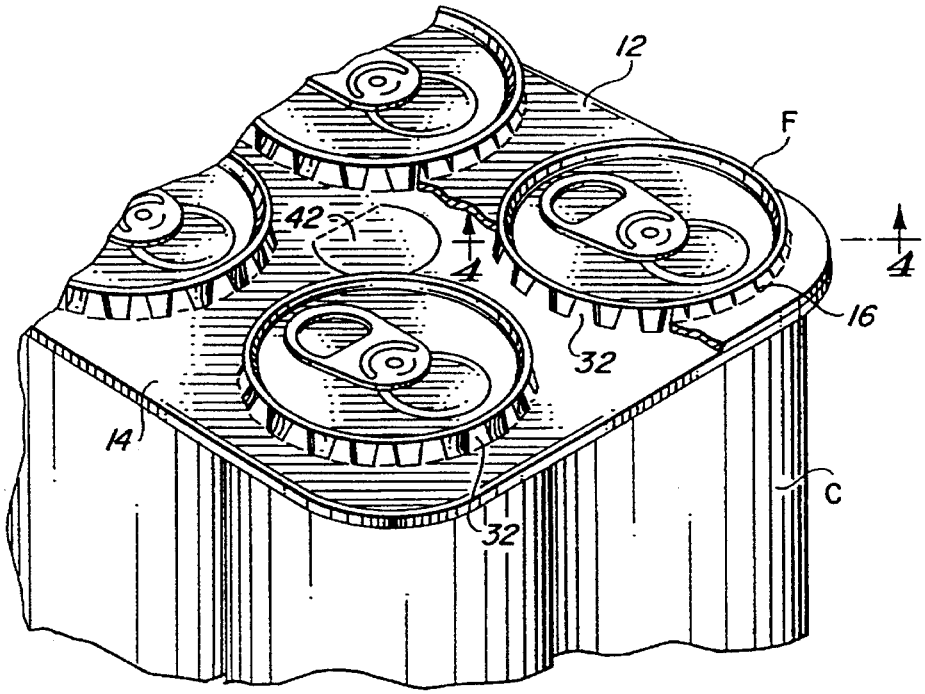
FIG. 3 is a partial pictorial view showing portions of the top and bottom panels of the carrier, with the top panel being broken away to reveal both top and bottom support tabs engaging beverage cans packaged in the carrier.

To form a package, the bottom panel section 14 of the blank 20 is positioned on top of a group of six adjacent cans which have been arranged in two rows of three each so that the bottom panel apertures 30 are aligned with the cans, with the support tabs 30 overlying the can chimes. Relative movement between the apertures and the cans is caused by applying downward pressure to the bottom panel section. The relative upward movement of the cans pivots the support tabs 32 up about their fold lines 34 until the ends of the support tabs pass beneath the can chimes and snap into place against the upper portion of the cans. The support tabs 32 at that time engage the bottom of the can chimes F, as illustrated in FIG. 3. The resiliency or memory of the tabs causes them to be biased toward the cans so that the support tab edges remain in contact with the underside of the can chimes. As illustrated, although the tabs 32 are spaced apart, the spacing between tabs is such that the tabs provide substantially continuous support around the circumference of an associated can chime.

The top panel section is then folded down about the fold line 22 until the apertures 24 in the top panel section are aligned with the cans and the support tabs 16 overlie the can chimes. Note in FIG. 2 that the fold line 22 is spaced a slightly greater distance from the adjacent apertures 24 in the top panel section than from the adjacent apertures 30 in the bottom panel section. This takes into account the thickness of the top panel section so that the apertures 24 are aligned with the apertures 30 when the top panel section is folded over. The top panel section is then pushed down relative to the cans, which pivots the support tabs 16 up about their fold lines 26 in the same manner as described in connection with the support tabs 32, until the ends of the support tabs engage the bottom of the can chimes F to produce the carrier package of FIG. 1.

Figure 4:
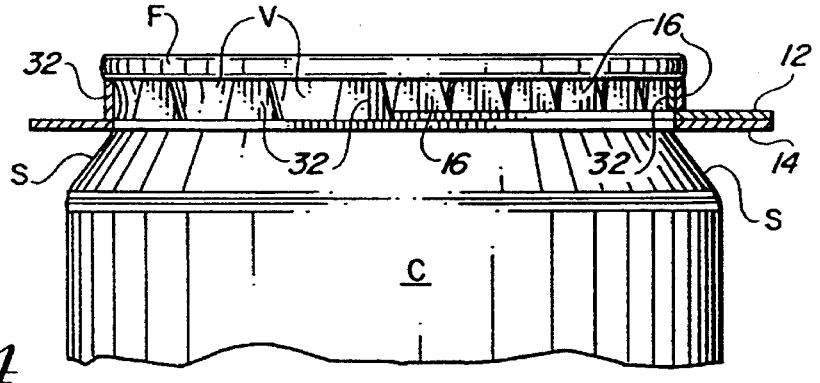
FIG. 4 is a partial transverse sectional view of the carrier taken along line 4—4 of FIG. 3.

When the support tabs 32 of the bottom panel section are pivoted into place, the inner faces of the tabs 32 are brought into contact with the upper portion of the associated can just below the can chime F. When the support tabs 16 of the top panel section are pivoted into place, the inner faces of the tabs 16 which are aligned with a tab 32 are brought into contact with the outer face of that tab, while the inner faces of the tabs 16 which are located between two adjacent tabs 32 are brought into contact with the upper portion of the associated can between those two adjacent tabs 32. This arrangement is illustrated in FIGS. 3 and 4. In FIG. 3, part of the top panel 12 has been cut away to reveal the bottom panel support tabs 32 in their final operative position. The illustrated top panel support tabs 16 are continuously arranged about the can-receiving aperture, and so contact both the tabs 32 and the can C between the tabs 32. Because the thickness of the paperboard is quite small compared to the distance that a can chime projects out beyond the upper side of a can, the ends of both the tabs 16 and 32 are able to contact the can chimes to support the cans in the package. This is brought out best in FIG. 4, which shows both tabs engaging the can chime at the right of the can.

As illustrated in FIGS. 3 and 4, the support tabs 32, being connected to the bottom panel, are longer than the support tabs 16 in order for both the support tabs 16 and 32 to reach an associated can chime. FIG. 4 also illustrates that the upper portion of a typical beverage can C includes an inwardly sloped portion S and a short substantially vertical portion V, with the support tabs 16 and 32 being located in the area of the vertical portion V. This arrangement is made possible by the fact that the top and bottom support panels are both located only a short distance from the top of the cans, thereby permitting the use of short support tabs. This is in contrast to the typical can clip arrangement in which the support tabs are relatively long, originating from a support panel spaced a relatively great distance from the tops of the cans, thereby primarily engaging the sloped portion S. In the latter case the support tabs are normally quite wide in order to resist buckling. In the present invention the short length of the tabs allows the tabs to be quite narrow while still providing resistance against buckling. This in turn allows a large number of tabs to be provided, thereby providing substantially continuous support about the circumference of the can.

The support tabs 16 of the top panel not only provide support for the cans in a package, but also maintain constant pressure against adjacent support tabs 32 to assist in maintaining the tabs 32 in their support position. The radially inward pressure exerted by both top and bottom tabs results in the cans being tightly gripped by the tabs. This pressure results in an extremely tight grip which, in combination with the support provided by the engagement of the ends of the tabs with the can chimes, very securely holds the cans in place.

Figure 5:
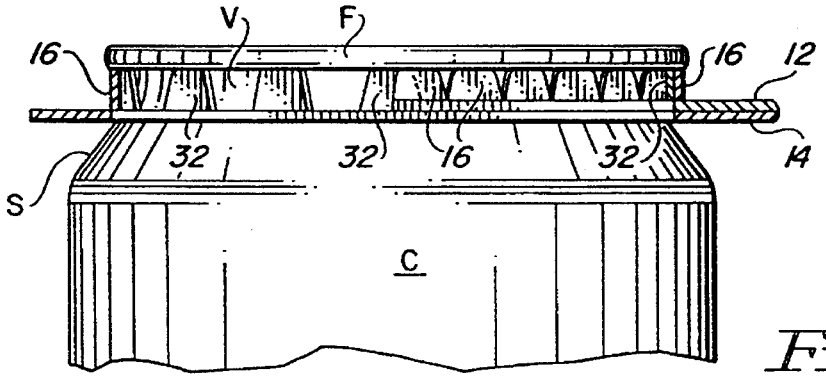
FIG. 5 is a partial transverse sectional view similar to that of FIG. 4, but showing a different support tab arrangement.

When the widths of the tabs 16 and 32 are the same and the width of the spaces between the tabs 32 is also the same, the tabs can be arranged so that alternate tabs 16 contact the spaces between the tabs 32, as in FIGS. 3 and 4. Even if the tabs are not so arranged, however, as in the case where a tab 16 partially overlies an adjacent tab 32 so that a portion of the tab 16 contacts the can and a portion contacts the tab 32, as shown in the arrangement of FIG. 5, the tabs 16 will still always provide support by contacting the can chimes and by applying pressure on the adjacent support tab 32 to hold it in operative position.

To lift a package of cans, one merely inserts the fingers through the finger holes in the top panel, pushing the aligned finger hole tabs 18 and 42 down through the aligned finger hole in the bottom panel. The tabs fold under the edges of the finger holes in the bottom panel to provide support for the fingers when lifting and carrying the package. Although the described finger hole arrangement ie preferred, obviously the provision of finger hole tabs in either the top or the bottom panel is a matter of choice.

Although it is preferred to form the carrier from an integral blank of the type shown, the top and bottom panels may be formed from separate blanks if desired. In such case the bottom panel would simply be applied first and a separate top panel subsequently applied. The action of the support tabs of each panel would remain the same as described above. An alternate method would be to initially glue the top and bottom panels together, leaving the support tabs of both panels unbonded and free to have separate movement, and then to apply the bonded panels to a group of cane as a unit. Since the support tabs of each panel of the unit are free to fold up into place when the panels are applied, the action of the support tabs of each panel would remain the same as described above.

It will now be clear that the invention improves the ability of paperboard carriers to carry cans by their top portions and guards against the cans coming loose by supporting them substantially entirely about their entire periphery. The package is made even sturdier by the use of two rows of tabs, with the tabs of the outer row holding the tabs of the inner row in place.

It will be understood that although the invention has been described in connection with a carrier adapted to hold a group of beverage cans, the carrier could be designed to hold other types of flanged articles. It should be appreciated that the invention need not necessarily be limited to all the specific details described in connection with the preferred embodiment, but that changes to certain features which do not alter the overall basic function and concept of the invention may be made without departing from the spirit and scope of the invention defined in the appended claims.

What is claimed is:

1. A package containing a plurality of articles each of which has an upper portion including an outwardly projecting lip, comprising:

a carrier comprised of a top panel and an adjacent substantially parallel bottom panel;

each panel containing a plurality of apertures through which the upper portions of the articles extend;

a plurality of support tabs connected to the top panel along fold lines adjacent the apertures, the top panel support tabs engaging the lip of an associated article;

a plurality of support tabs connected to the bottom panel along fold lines adjacent the apertures, the bottom panel support tabs engaging the lip of an associated article;

there being more top panel tabs than bottom panel tabs;

at least some of the bottom panel support tabs being located between and in contact with the upper portion of an associated article and an adjacent top panel support tab;

at least some of the bottom panel support tabs being spaced from adjacent bottom panel support tabs; and at least a portion of the width of one of the top panel support tabs being located between said spaced bottom panel support tabs in contact with the upper portion of an associated article.

2. A package as defined in claim 1, wherein the top panel support tabs are shorter than the bottom panel support tabs.

3. A package as defined in claim 1, wherein the entire width of said one top panel support tab is in contact with the upper portion of an associated article.

4. A package as defined in claim 1, wherein the bottom panel tabs and the top panel tabs are of equal width, the bottom panel tabs being spaced apart a distance substantially equal to the width thereof.

5. A package as defined in claim 1, wherein the top and bottom panels are in substantially face-to-face contact.

6. A package as defined in claim 1, wherein there are twice as many top panel tabs as bottom panel tabs.

7. A package containing a plurality of articles each of which has an upper portion including an outwardly projecting lip, comprising:

a carrier comprised of a top panel and an adjacent substantially parallel bottom panel;

each panel containing a plurality of apertures through which the upper portions of the articles extend;

a plurality of support tabs connected to the top panel along fold lines adjacent the apertures, the top panel support tabs engaging the lip of an associated article;

a plurality of support tabs connected to the bottom panel along fold lines adjacent the apertures, the bottom panel support tabs engaging the lip of an associated article; and at least some of the bottom panel support tabs being located between and in contact with the upper portion of an associated article and an adjacent top panel support tab;

the articles being beverage cans, each of which has a relatively short substantially vertical upper portion extending between the lip and a tapered portion of the can, the support tabs contacting the beverage cans on the substantially vertical portion thereof.

8. A blank for forming a carrier for supporting a plurality of articles each of which has an upper portion including an outwardly projecting lip, comprising:

a top panel section connected to a bottom panel section;

each panel section containing a plurality of apertures which are aligned with the apertures of the other panel section in a carrier formed from the blank;

a plurality of support tabs connected to the top panel section adjacent the apertures therein;

a plurality of support tabs connected to the bottom panel section adjacent the apertures therein, the distance between adjacent bottom panel support tabs being greater than the distance between adjacent top panel support tabs;

the location and size of the support tabs being such that at least some of the bottom panel support tabs are located between and in contact with both the upper portion of an associated article and an adjacent top panel support tab in a carrier formed from the blank, both the bottom panel support tabs and the top panel support tabs engaging the lip of an associated article in such a carrier.

9. A blank as defined in claim 8, wherein the top panel support tabs are shorter, as measured radially inwardly of an associated aperture, than the bottom panel support tabs.

10. A blank as defined in claim 8, wherein the bottom panel tabs and the top panel tabs are of equal width, the bottom panel tabs being spaced apart a distance substantially equal to the width thereof.

11. A blank as defined in claim 8, wherein the top and bottom panels are connected along a fold line.

12. A blank as defined in claim 11, wherein the apertures in the top and bottom panel sections are spaced from the fold line, the apertures in the top panel section being spaced from the fold line a slightly greater distance than are the apertures in the bottom panel section.

* * * * *